US010641267B2

(12) United States Patent
Lee

(10) Patent No.: US 10,641,267 B2
(45) Date of Patent: May 5, 2020

(54) COMPONENT-REPLACEABLE WATER RING VACUUM PUMP

(71) Applicant: Vaccomp Co., Ltd., Incheon (KR)

(72) Inventor: Seok Won Lee, Incheon (KR)

(73) Assignee: VACCOMP CO., LTD., Incheon (KR)

( * ) Notice: Subject to any disclaimer, the term of this patent is extended or adjusted under 35 U.S.C. 154(b) by 272 days.

(21) Appl. No.: 15/889,466

(22) Filed: Feb. 6, 2018

(65) Prior Publication Data

US 2019/0063434 A1 Feb. 28, 2019

(30) Foreign Application Priority Data

Aug. 24, 2017 (KR) ..... 10-2017-0107153

(51) Int. Cl.
*F04C 19/00* (2006.01)
*F04C 29/02* (2006.01)
*F04C 27/00* (2006.01)

(52) U.S. Cl.
CPC ..... *F04C 19/001* (2013.01); *F04C 19/008* (2013.01); *F04C 27/00* (2013.01); *F04C 29/02* (2013.01); *F04C 2230/70* (2013.01); *F04C 2230/85* (2013.01); *F04C 2230/91* (2013.01); *F04C 2240/50* (2013.01); *F04C 2240/805* (2013.01)

(58) Field of Classification Search
CPC ..... F04C 19/001; F04C 19/008; F04C 27/02; F04C 29/02; F04C 2230/85; F04C 2230/70; F04C 2230/91; F04C 2240/50; F04C 2240/805; C10M 169/044; C10M 133/40; C10M 145/22; C10M 147/00; C10M 125/10; C10M 107/38; C10M 2201/062; C10M 2209/102; C10M 2213/023; C10M 2215/221; C10N 2230/06; C10N 2240/02; C10N 2250/141; F16J 15/3452; F16J 15/3496
USPC ..... 277/511, 572, 576–577
See application file for complete search history.

(56) References Cited

U.S. PATENT DOCUMENTS 1,525,332 A * 2/1925 Sommer ..... F04C 19/007 417/68
1,847,586 A * 3/1932 Adams ..... F04C 19/008 417/68

(Continued)

FOREIGN PATENT DOCUMENTS

KR 10-0433185 5/2004

*Primary Examiner* — Nathan C Zollinger
(74) *Attorney, Agent, or Firm* — Lex IP Meister, PLLC

(57) ABSTRACT

Disclosed is a component-replaceable water ring vacuum pump in which inner components within a head unit may be disassembled and replaced without separation of the head unit from a main body, thus shortening an operation time and improving operation efficiency through prevention of leakage of an inner liquid during a replacement process. The water ring vacuum pump includes a main body provided with a shaft, a rotor rotated together with the shaft within the main body, a head unit coupled to both sides of the main body, a guide bearing provided within the head unit, and a mechanical seal configured to block inner gas. A bearing bracket to support the guide bearing is detachably fastened to one side of the head unit by a bolt, and an inner cap and an outer cap are assembled to the inner and outer surfaces of the bearing bracket by fixing bolts.

4 Claims, 6 Drawing Sheets

(56) References Cited

U.S. PATENT DOCUMENTS

| | | | | | |
|---|---|---|---|---|---|
| 3,154,240 | A * | 10/1964 | Jennings | F04C 19/008 | 417/54 |
| 3,776,659 | A * | 12/1973 | Coon, Jr. | F04D 9/02 | 415/200 |
| 4,132,504 | A * | 1/1979 | Fitch | F04C 19/007 | 417/238 |
| 4,498,844 | A * | 2/1985 | Bissell | F04C 19/008 | 417/68 |
| 4,509,773 | A * | 4/1985 | Wentworth | F04D 29/126 | 277/380 |
| 4,637,780 | A * | 1/1987 | Grayden | F04C 19/007 | 417/68 |
| 5,423,614 | A * | 6/1995 | Wunner | F01C 21/007 | 384/428 |
| 6,315,524 | B1 * | 11/2001 | Muhs | F04D 7/045 | 417/199.2 |
| 6,354,808 | B1 * | 3/2002 | Shenoi | F04C 19/004 | 417/68 |
| 6,551,071 | B1 * | 4/2003 | Blender | F01C 21/10 | 417/68 |
| 7,648,344 | B2 * | 1/2010 | Wenckebach | F01C 21/108 | 417/68 |
| 9,541,086 | B2 * | 1/2017 | Beers | F04C 19/005 | |
| 2008/0038120 | A1 * | 2/2008 | Lengyel | F04C 19/00 | 417/68 |
| 2013/0209251 | A1 * | 8/2013 | Diakomis | F04C 27/009 | 415/230 |
| 2019/0063434 | A1 * | 2/2019 | Lee | C10M 133/40 | |

* cited by examiner

COMPONENT-REPLACEABLE WATER RING VACUUM PUMP

BACKGROUND OF THE INVENTION

Field of the Invention

The present invention relates to a water ring vacuum pump and, more particularly, to a water ring vacuum pump having a prefabricated structure in which components in a head unit are replaceable without disassembly of a casing of the head unit.

Description of the Related Art

In general, a water ring vacuum pump compresses and transfers gas using centrifugal force generated by rotating a liquid filling the inside of the water ring vacuum pump using rotary force of an impeller eccentrically arranged therein, and the water ring vacuum pump together with a vane pump and a roots pump is commercialized as a low vacuum pump in a pressure range around atmospheric pressure.

As one example of such a conventional water ring vacuum pump, Korean Patent Registration No. 433185 discloses a water ring vacuum pump to which vibration suppression control technology is applied.

Inner components, such as a bearing, a sealing material, etc., are mounted in a head unit (front casing) of a water ring vacuum pump and replacement of the corresponding components is periodically carried out according to the term of use of the pump.

However, since a conventional water ring vacuum pump includes a head unit having an integral structure, in order to replace an inner component of the head unit with a new one, a casing corresponding to a weight should be separated from a pump main body and, thereby, several problems, such as leakage of inner gas and a liquid, increase in an operation time, and occurrence of safety accidents during an operation process, may be caused.

SUMMARY OF THE INVENTION

Therefore, the present invention has been made in view of the above problems, and it is an object of the present invention to provide a water ring vacuum pump having a prefabricated structure in which a head unit may be partially disassembled and thus inner components are rapidly and easily replaceable.

In accordance with the present invention, the above and other objects can be accomplished by the provision of a component-replaceable water ring vacuum pump including a main body provided with a shaft formed at the center of the inside thereof to receive rotary force from a driving motor, a rotor rotated together with the shaft within the main body, a head unit coupled to both sides of the main body so as to have a symmetrical structure, a guide bearing provided within the head unit to guide rotation of the shaft, and a mechanical seal configured to block inner gas, wherein a bearing bracket to support the guide bearing is detachably fastened to one side of the head unit by a bolt, and an inner cap and an outer cap are assembled to the inner and outer surfaces of the bearing bracket by fixing bolts.

The mechanical seal may be fixed to the inside of the main body by a seal fastening bolt.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
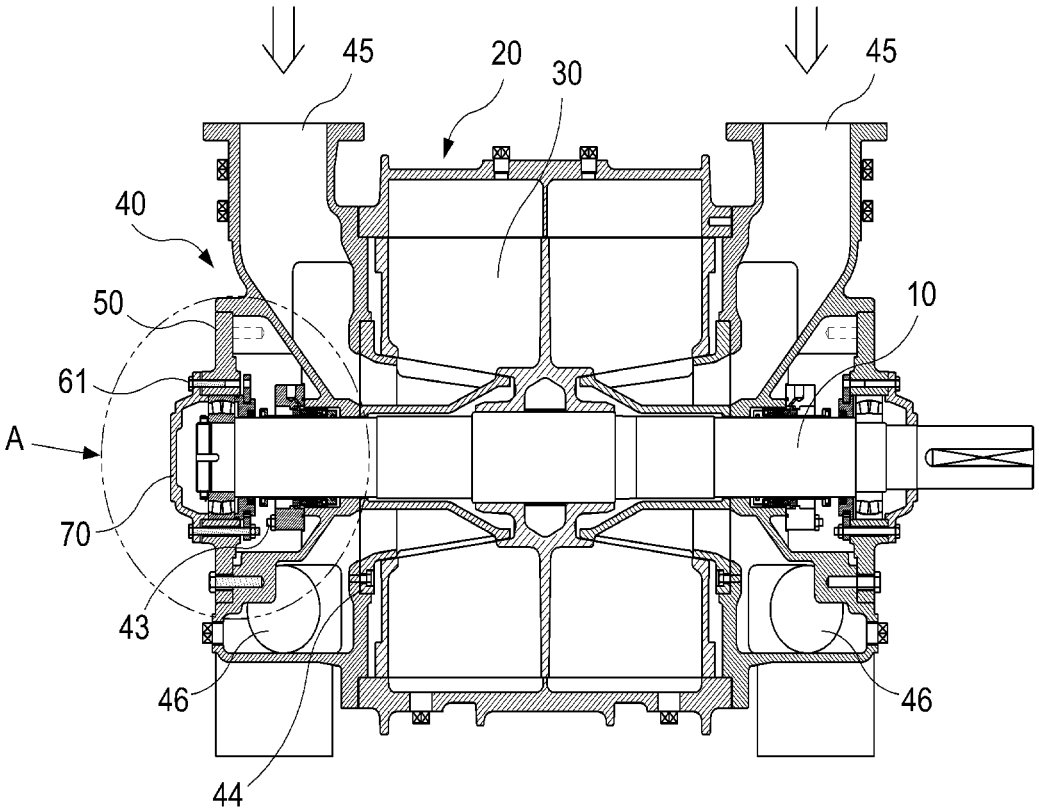
FIG. 1 is a cross-sectional view of a water ring vacuum pump in accordance with one embodiment of the present invention.
Figure 2:
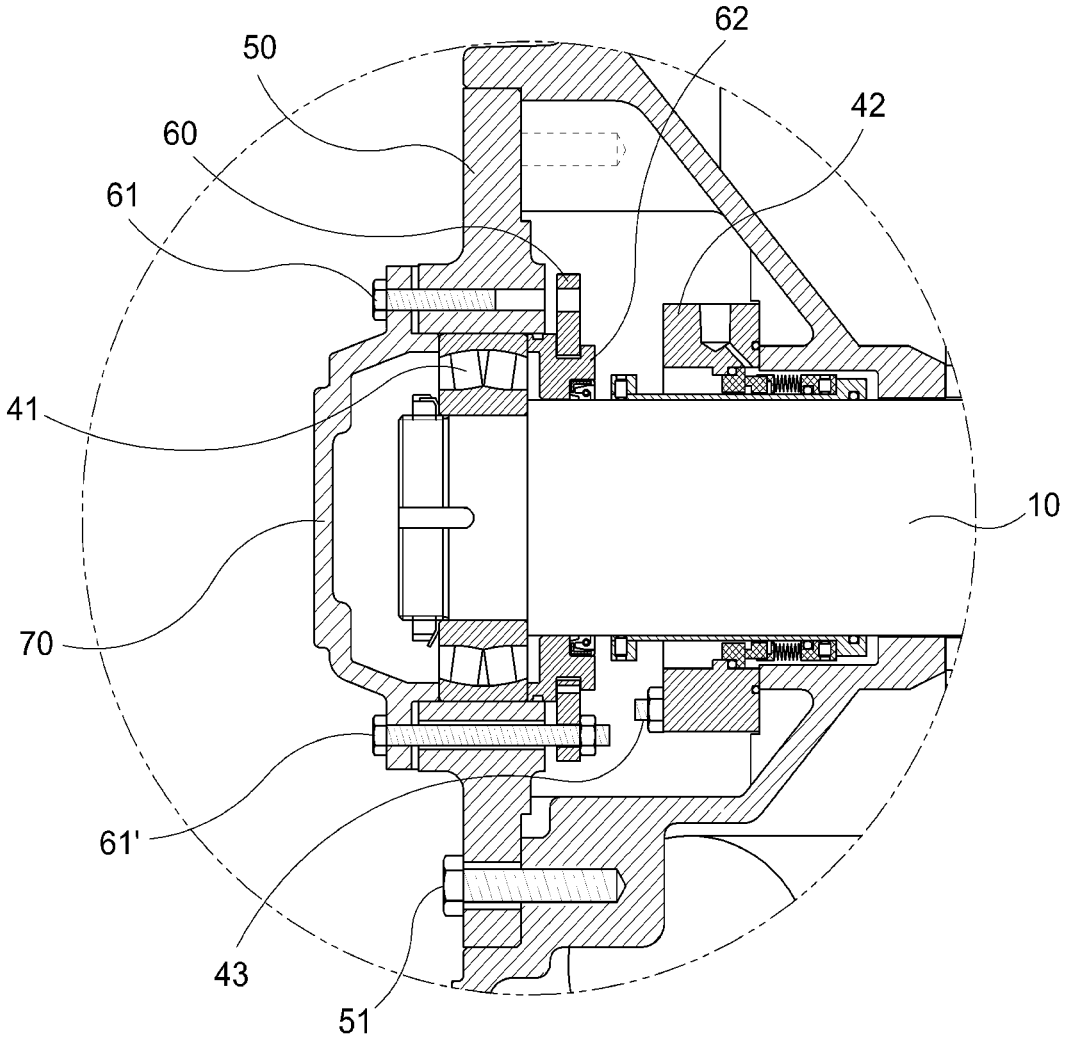
FIG. 2 is an enlarged view of portion A of FIG. 1.

Reference will now be made in detail to the preferred embodiments of the present invention, examples of which are illustrated in the accompanying drawings.

Hereinafter, a configuration of a water ring vacuum pump in accordance with one embodiment of the present invention will be described with reference to FIGS. 1 to 4.

The water ring vacuum pump in accordance with this embodiment includes a main body 20 provided with a shaft 10 formed at the center of the inside thereof to receive rotary force from a driving motor M, a rotor 30 rotated together with the shaft 10 within the main body 20, a head unit 40 coupled to both sides of the main body 20 so as to have a symmetrical structure, a guide bearing 41 provided within the head unit 40 to guide rotation of the shaft 10, and a mechanical seal 42 to block inner gas.

Particularly, in the present invention, a bearing bracket 50 to support the guide bearing 41 is detachably fastened to one side of the head unit 40 by a bolt 51, and an inner cap 60 and an outer cap 70 are assembled to the inner and outer surfaces of the bearing bracket 50 by fixing bolts 61 and 61'.

Further, the mechanical seal 42 is fixed to the inside of the main body 20 by a seal fastening bolt 43.

Further, the inner cap 60 is supported by a guide ring 62 installed to contact the outer circumferential surface of the shaft 10, a receipt groove 62*a* to stably support and receive the inner cap 60 is formed on the outer circumferential surface of the guide ring 62, and a separation protrusion 62*b* maintaining a designated separation distance from the guide bearing 41 to prevent increase in frictional force caused by surface contact and an adhesion state between components protrudes from one side of the guide ring 62.

In the drawings, non-described reference numeral 44 indicates a gasket, non-described reference numeral 45 indicates an inlet through which gas is introduced into the water ring vacuum pump, and non-described reference numeral 46 indicates an outlet.

Hereinafter, functions and effects of the water ring vacuum pump having the above-described configuration in accordance with the present invention will be described.

In the water ring vacuum pump in accordance with the present invention, when inner components, i.e., the guide bearing 41 and the mechanical seal 42, are replaced, the head unit 40 is not separated from the main body 20 and the bearing bracket 50 and the outer cap 70 may be separated from the head unit 40.

Figure 3:
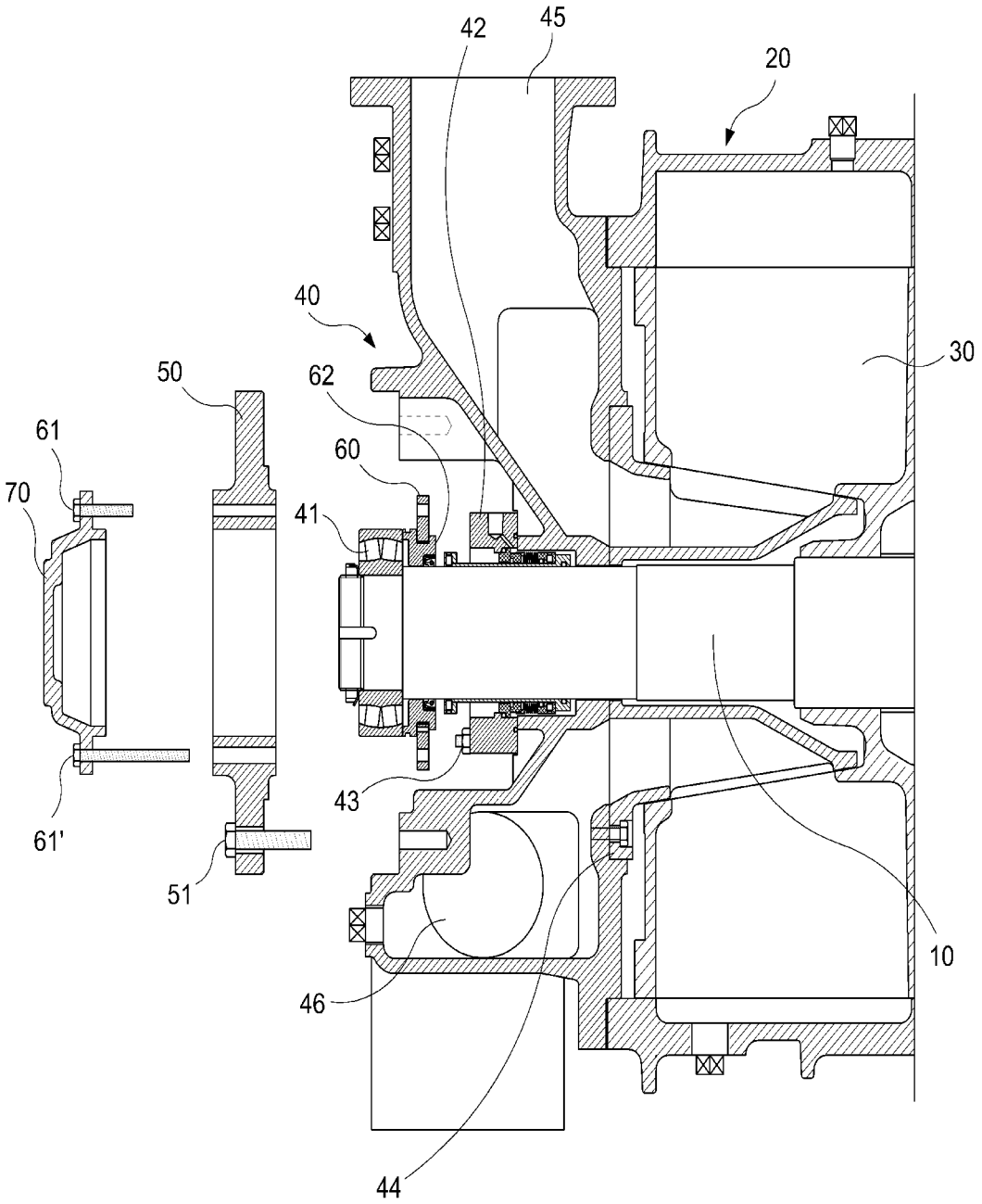
FIG. 3 is a cross-sectional view of the water ring vacuum pump, from which a bearing bracket is separated.
Figure 4:
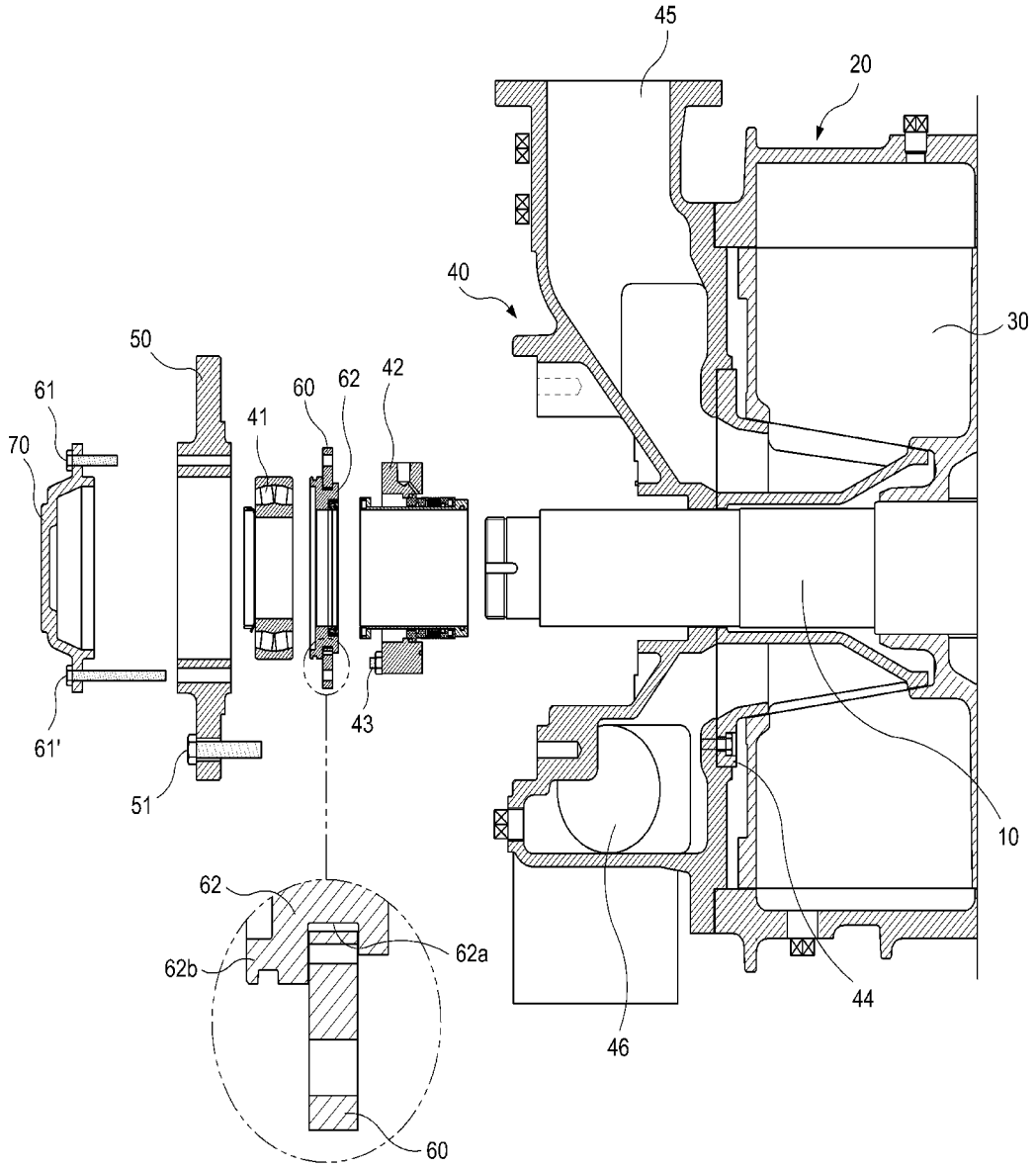
FIG. 4 is a cross-sectional view of the water ring vacuum pump, from which inner components of a head unit are separated.

That is, when the bearing bracket 50 and the outer cap 70 are separated from the head unit 40 by removing the bolt 51 and the fixing bolts 61 and 61', the guide baring 41 and the mechanical seal 42 are exposed to the outside, as exemplarily shown in FIG. 3.

Thereafter, the guide bearing 41, the inner cap 60 and the guide ring 62 are separated from the shaft 10 so as to be replaceable and, as needed, replacement of the mechanical seal 42 provided therein is carried out.

Therefore, in the present invention, the inner components provided within the head unit 40 may be disassembled and replaced without separation of the head unit 40 from the main body 20 and, thus, an operation time may be shortened and operation efficiency may be improved through prevention of leakage of an inner liquid during a replacement process.

Figure 5:
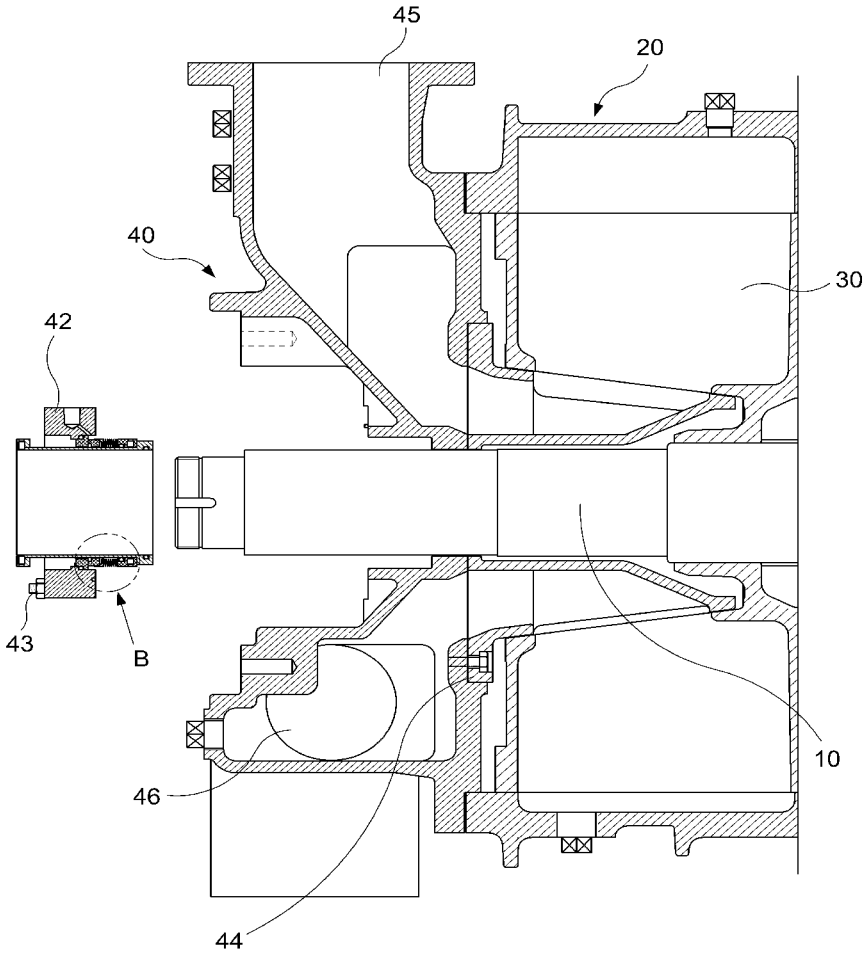
FIG. 5 is a cross-sectional view of a water ring vacuum pump in accordance with another embodiment of the present invention, from which a mechanical seal is separated.
Figure 6:
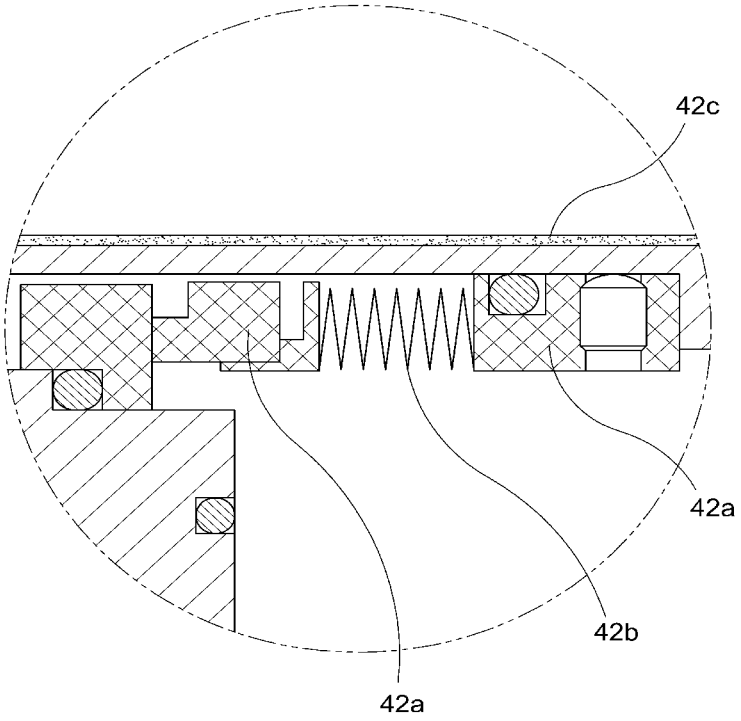
FIG. 6 is an enlarged view of portion B of FIG. 5.

FIGS. 5 and 6 illustrate a configuration of a water ring vacuum pump in accordance with another embodiment of the present invention, in which a plurality of packing blocks 42*a* formed of rubber is provided at one side of a mechanical seal 42 and the packing blocks 42*a* are mutually connected by an elastic spring 42*b*.

Further, the inner circumferential surface of the mechanical seal 42 is coated with a protective layer 42*c* to prevent generation of cracks due to friction with a shaft 10, and the protective layer 42*c* includes 20-40% by weight of Teflon, 10-30% by weight of elastomer powder, 10-20% by weight of oyster shell powder, 5-10% by weight of fluororesin, 5-10% by weight of polyethylene terephthalate and 1-10% by weight of pyridoxic acid.

Through such a configuration, elastic interaction of the elastic spring 42*b* is applied to both packing blocks 42*a* and thus an inner airtight condition may be stably maintained, and, when a seal fastening bolt 43 is separated from the mechanical seal 42 during a disassembly process, the seal fastening bolt 43 may be more easily separated from the mechanical seal 42 by elastic force of the elastic spring 42*b*.

Further, the protective layer 42*c* includes Teflon which is a lubricative material and may thus reduce friction with the shaft 10 and prevent damage to or deformation of the mechanical seal 42. Moreover, the protective layer 42*c* additionally includes elastomer powder and oyster shell powder for increasing durability and may thus prevent generation of cracks.

Further, fluororesin has excellent thermal and chemical properties and thus performs a function of preventing detachment of the protective layer 42*c* due to external friction, and polyethylene terephthalate performs a function of assisting formation of the protective layer 42*c* having a uniform thickness.

Further, pyridoxic acid which is added to the protective layer 42*c* serves to prevent oxidation of the protective layer 42*c*.

As apparent from the above description, a component-replaceable water ring vacuum pump in accordance with the present invention has a prefabricated structure in which inner components provided within a head unit may be disassembled and replaced without separation of the head unit from a main body, thus shortening an operation time and improving operation efficiency through prevention of leakage of inner gas and a liquid during a replacement process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A component-replaceable water ring vacuum pump comprising:

a main body provided with a shaft formed at the center of the inside thereof to receive rotary force from a driving motor;

a rotor rotated together with the shaft within the main body;

a head unit coupled to both sides of the main body so as to have a symmetrical structure;

a guide bearing provided within the head unit to guide rotation of the shaft; and a mechanical seal configured to block inner gas, wherein:

a bearing bracket to support the guide bearing is detachably fastened to one side of the head unit by a bolt; and an inner cap and an outer cap are assembled to the inner and outer surfaces of the bearing bracket by fixing bolts, wherein the inner cap is supported by a guide ring installed to contact an outer circumferential surface of the shaft, a receipt groove to stably support and receive the inner cap is formed on an outer circumferential surface of the guide ring, and a separation protrusion to maintain a designated separation distance from the guide bearing protrudes from one side of the guide ring.

2. The component-replaceable water ring vacuum pump according to claim 1, wherein the mechanical seal is fixed to the inside of the head unit by a seal fastening bolt.

3. A component-replaceable water ring vacuum pump comprising:

a main body provided with a shaft formed at the center of the inside thereof to receive rotary force from a driving motor;

a rotor rotated together with the shaft within the main body;

a head unit coupled to both sides of the main body so as to have a symmetrical structure;

a guide bearing provided within the head unit to guide rotation of the shaft; and a mechanical seal configured to block inner gas, wherein:

a bearing bracket to support the guide bearing is detachably fastened to one side of the head unit by a bolt; and an inner cap and an outer cap are assembled to the inner and outer surfaces of the bearing bracket by fixing bolts, wherein an inner circumferential surface of the mechanical seal is coated with a protective layer to prevent generation of cracks due to friction with the shaft, and the protective layer includes 20-40% by weight of Teflon, 10-30% by weight of elastomer powder, 10-20% by weight of oyster shell powder, 5-10% by weight of fluororesin, 5-10% by weight of polyethylene terephthalate and 1-10% by weight of pyridoxic acid.

4. A component-replaceable water ring vacuum pump comprising:

a main body provided with a shaft formed at the center of the inside thereof to receive rotary force from a driving motor;

a rotor rotated together with the shaft within the main body;

a head unit coupled to both sides of the main body so as to have a symmetrical structure;

a guide bearing provided within the head unit to guide rotation of the shaft; and a mechanical seal configured to block inner gas, wherein:

a bearing bracket to support the guide bearing is detachably fastened to one side of the head unit by a bolt; and an inner cap and an outer cap are assembled to the inner and outer surfaces of the bearing bracket by fixing bolts, wherein a plurality of packing blocks formed of rubber is provided at one side of the mechanical seal, and the packing blocks are mutually connected by an elastic spring, and wherein an inner circumferential surface of the mechanical seal is coated with a protective layer to prevent generation of cracks due to friction with the shaft, and the protective layer includes 20-40% by weight of Teflon, 10-30% by weight of elastomer powder, 10-20% by weight of oyster shell powder, 5-10% by weight of fluororesin, 5-10% by weight of polyethylene terephthalate and 1-10% by weight of pyridoxic acid.

* * * * *